United States Patent [19]

Gärtner

[11] Patent Number: 5,028,897

[45] Date of Patent: Jul. 2, 1991

[54] MICROWAVE TRANSMISSION ARRANGEMENT

[75] Inventor: Georg Gärtner, Aachen, Fed. Rep. of Germany

[73] Assignee: U.S. Philips Corporation, New York, N.Y.

[21] Appl. No.: 407,518

[22] Filed: Sep. 15, 1989

[30] Foreign Application Priority Data

Sep. 16, 1988 [DE] Fed. Rep. of Germany ..... 3831453

[51] Int. Cl.[5] ..... H01P 1/00

[52] U.S. Cl. ..... 333/248; 333/252

[58] Field of Search ..... 333/248, 252, 99 PL

[56] References Cited

U.S. PATENT DOCUMENTS

| | | | |
|---|---|---|---|
| 3,287,674 | 11/1966 | Stiegler, Jr. | 333/248 |
| 3,778,799 | 12/1973 | Bendayan | 333/248 X |
| 4,286,240 | 8/1981 | Shively et al. | 333/252 |
| 4,877,642 | 10/1989 | Gartner et al. | 427/38 |

*Primary Examiner*—Paul Gensler

*Attorney, Agent, or Firm*—Jack D. Slobod

[57] ABSTRACT

The microwave transmission between wave guide regions (a, b) having different internal gas pressures and/or different fill-gas compositions, that is to say, the coupling or outcoupling of microwaves of such a wave guide region into another region is improved in that between the wave guide regions at least a single pumping stage (6, 7, 8, 9) is inserted. The wave guide (1) is connected to the pumping stages preferably via the slots (2, 3, 4, 5) which do not virtually outcouple the microwave power.

14 Claims, 1 Drawing Sheet

MICROWAVE TRANSMISSION ARRANGEMENT

BACKGROUND OF THE INVENTION

1. Field of the Invention

The invention relates to an arrangement for microwave transmission between wave guide regions having different internal gas pressures and/or different fill-gas compositions, that is to say, for coupling or outcoupling microwaves of such a wave guide region into another region.

2. Description of the Related Art

In German Patent Application No. DE-OS 36 22 614 which corresponds to commonly owned U.S. Pat. No. 4,877,642, is disclosed a method of manufacturing electrically conductive moulded bodies by a plasma-activated chemical deposition from a gaseous phase. With such methods the coupling of high-power microwaves is effected through a hermetically sealed insulating microwave aperture of dielectric material in a microwave resonator used as a reaction chamber, in which a plasma is formed and electrically conductive layers are chemically deposited. During this process the problem arises that an electrically conductive film generally covers the surface of the microwave aperture arranged at the coupling place, that is, its inside surface facing the reaction chamber, as a result of which the coupling is stopped. This problem is solved according to DE-OS 36 22 614 either by having the inside of the microwave aperture rinsed by an inertial gas, or selecting for the microwave aperture a dielectric material which is kept free from growth of electrically conductive film as a result of an etching reaction with one of its reaction partners.

A cognate problem occurs when high-power microwaves from gyrotrons are outcoupled during transition from high-vacuum to air. With microwave powers of the order of 0.1 to 1 MW the thermal load of the known materials used for microwave apertures becomes too large, as a result of which the output power is restricted. With maximum power levels of 0.3 MW one manages by enlarging the wave guide and additionally cooling the aperture consisting of, for example, $Al_2O_3$.

Evacuation of a wave guide through non-radiating or non-coupling slots is known from British Patent Specification No. GB-PS 644,749.

SUMMARY OF THE INVENTION

It is an object of this invention to improve the microwave transmission between wave guide regions having different internal gas pressures and/or different fill-gas compositions.

According to the invention this object is achieved in that at least one pumping stage is inserted between the wave guide regions.

A pumping stage is understood to mean a pump pipe with a pump and a pressure controller, the pump always being located outside the wave guide.

When operating the arrangement according to the invention, gas is evacuated at no less than one spot between the wave guide regions.

The pressure of the pumping stages is preferably controllable whereas the flow resistance of the wave guide sections between the pumping stages, the throughput of the pumps, and the pressure controllers are dimensioned or can be adjusted such that a preset pressure difference between the wave guide regions is produced and maintained—worded differently: the throughput of each pump has a region of target-pressure which is larger than or equal to the flow resistance of the wave guide section between the input of the pumping stage having a higher pressure and the evacuation spot respectively, and the pressure control is set at the evacuation spot for its target pressure region (at which spot there is also available a pressure sensor or a manometer).

Each pumping stage is preferably located nearest possible to the side where there is low pressure.

In a preferred embodiment of the invention the wave guide of a specific microwave mode has a single slot or slots at successive spots, the single slot or the slots having very little or negligible outcoupling of the microwave mode and in which the wave guide is connected to the pumping stage through the single slot or to the successive pumping stages through the slots, which stages have each an adjusted throughput.

This embodiment is based on the general idea of differential pumps. The wave guide is evacuated through the slots in successive pumping stages, so that the microwave is led either from a region of high internal gas pressure (for example, air at atmospheric pressure) into a region of low internal gas pressure (for example, 10 hPa) in the wave guide or, conversely, from a region of low into a region of high internal gas pressure.

In this embodiment of the invention the wave guide preferably has a rectangular cross-section and is multi-helical.

The slots are preferably provided in the wave guide side walls, in the narrow sides that is, and have the form of vertical rectangles.

The distances between the slots are preferably integer multiples of half the wave guide length.

A further advantage, especially for lower microwave frequencies, for example below 40 GHz, is the fact that resonance shutters are inserted in the wave guide.

In a further preferred embodiment of the invention relating to the use in combination with a microwave plasma reactor for example, in accordance with DE-OS 36 22 614, a microwave aperture is provided between the wave guide region connected to a microwave oscillator and the low-pressure region produced by the (first) pumping stage, the first pumping stage being designed such that it is able to produce a low final pressure in a manner such that no discharge is ignited.

In this connection it is preferred that between the first pumping stage and a reaction chamber arranged as a microwave resonator a second pumping stage is inserted to relieve the first pumping stage and discharge the gas from the reaction chamber.

Furthermore, it is advantageous to insert between the first pumping stage and the second pumping stage at least a single resonance shutter.

In a variant of the embodiment of the invention described hereinbefore, the wave guide within the region of the first pumping stage is filled with a gas having a high dielectric strength.

In a variant of the invention the pumping stage comprises a double-walled resonance shutter which is designed as a nozzle for a flat high-velocity liquid jet.

In a further variant of the invention the wave guide is filled with a rinsing gas, a quenching gas or reactive gases. This will be further explained hereinbelow.

In all above-mentioned microwave transmission arrangements according to the invention it is efficient to further provide at least one EH tuner and/or one probe transformer in the wave guide to make a phase or length adjustment and to tune to maximum power transmission.

Furthermore, it is efficient that between the wave guide regions various low-attenuation wave guide couplers attached to each other are inserted, which are connected each to a pump for setting a specific preset pressure level, whereas the wave guide coupler regions located between the wave guide regions comprise short-circuit slides at the ends and comprise each an EH tuner for tuning the transmission section. This will be further explained hereinbelow.

BRIEF DESCRIPTION OF THE DRAWING

Several exemplary embodiments of the invention are represented in the appended drawing and will further be explained in the detailed description. The drawing Figures show in a perspective representation in.

DETAILED DESCRIPTION OF THE PREFERRED EMBODIMENT

Figure 1:
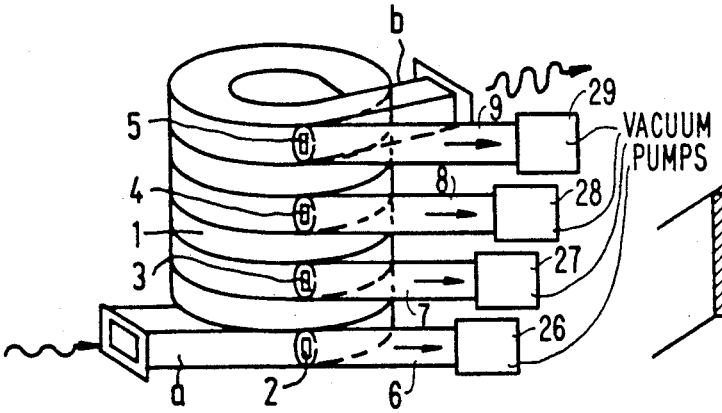
FIG. 1 an arrangement for microwave transmission with a multi-helical wave guide, FIG. 2 a resonance shutter, FIG. 3 an arrangement for microwave transmission with a microwave aperture and pump extension, FIG. 4 a nozzle microwave aperture.

FIG. 1 shows a high-pressure wave guide region (for example, air, 1000 hPa) designated "a" and a low-pressure wave guide region designated "b".

A microwave of the $TE_{10}$ type is led into a multi-helical curved rectangular wave guide line 1 either from "a" to "b" or from "b" to "a", depending on its use. In the walls of the wave guide, in the narrow sides that is, vertical rectangular slots 2, 3, 4, 5 are provided at distances $d_1$ of integer multiples $p_i$ of half the wave guide length $\Lambda$, thus where $d_i = p_i \cdot \Lambda/2$ (with $p_i = 1$, 2 and so on), which slots are characterized by little outcoupling of the $TE_{10}$ mode, and thus cause only a relatively small attenuation of this type of wave. On the outside of these slots, exhaust tubes 6, 7, 8 and 9 are positioned through which the line is successively evacuated to low pressure in the direction of "b" by means of various vacuum pumps 26, 27, 28 and 29.

The pressure difference $\Delta p = p_a - p_b$ to be set between "a" and "b" is determined by the throughput and final pressure of the pumps, by the number of pumping stages, the distance of the slots and the cross-section of each type of wave guide. A large difference of pressure can be achieved, for example, for the E band (60 to 90 GHz) in a simpler way than for the X band (8 to 12 GHz), as a result of the strongly reduced cross-section of the E band wave guide compared to the X band wave guide.

In the following example the arrangement as shown in FIG. 1 is used for the microwave plasma activated CVD of electrically conductive substances.

EXAMPLE 1.

In region "a" an X band waveguide 1 is filled with air under $Pa \leqq$ normal pressure and connected to an X band microwave transmitter having 300 W CW output. The slots 2 to 4 do not occur in this example and evacuation is effected via a slot 5 by means of only a single rotary vane pump having a throughput of $S_p = 580\ m^3/h$, since the pressure drop is essentially determined by the flow resistance (to air) of the wave guide. According to A. Roth's "Vacuum Technology", pp. 75–76, the flow conductance C (which is the reciprocal of flow resistance) to air in a rectangular tube, having the length L and having the cross-sectional area A.B (for laminar flow), is given by $$C = [260 \cdot Y \cdot (A^2B^2/L)/2] \cdot (p_a + p_b) = C_o(p_a + p_b) \quad (1)$$

where $Y = 0.82$ for $A = 2B$ (A and B cf. FIG. 2) and $[C] = 1/sec$, $[A] = [B] = [L] = cm$, $[p_a] = Torr = 1.33$ hPa. The pressure difference $p_a - p_b$ between the beginning of the tube and the end of the tube can now be computed from the throughput $S_p$, flow Q and the conductance C (utilizing that $Q = p_b \cdot S_p$):

$$p_a - p_b = Q/C = p_b \cdot S_p / [C_o(p_a + p_b)] \quad (2)$$

The solution of (2) for $p_b$ yields $$p_b = (p_a^2 + (S_p/2C_o)^2)^{\frac{1}{2}} - S_p/2C_o \quad (3)$$

If we substitute in (2) $A = 2.29$ cm, $B = 1.02$ cm and $L \cong 2600$ cm and if we then substitute in (3) the resulting $C_o$ and $p_a = 760$ Torr $= 1013$ hPa, $S_p = 580\ m^3/h$, then $p_b = 385$ Torr $= 512$ hPa and therefore $p_a - p_b = 375$ Torr $= 500$ hPa.

The doubling of $p_a - p_b = 750$ Torr $= 1000$ hPa is obtained by inserting resonance shutters (see FIG. 2) into the rectangular wave guide interspaced by $n.\Lambda/2$ which, tuned at 10 GHz, transmit this frequency in an unattenuated fashion and simultaneously enhance the flow resistance as desired. For this purpose, one resonance shutter for each distance of $28\Lambda$ ($\Lambda = 3.97$ cm for $TE_{01}$ and $\nu_o = 10$ GHz) will suffice, or approximately every 110 cm along the spiral (thus once per winding having a central cross-section of approximately 35 cm), thus a total of 24 shutters. This arrangement for the X band measures approximately 37 cm in outside diameter and approximately 30 cm in height and is rather compact.

The attenuation estimate for a rectangular wave guide having copper inside walls, with $\nu_o = 10$ GHz and $L = 26$ m, yields a value of 26 m. 0.026 dB/m = 0.676 dB and is thus less than 20%.

Figure 2:
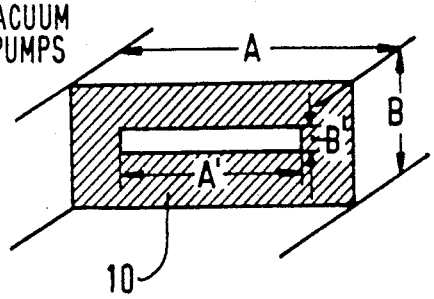

FIG. 2 shows such a resonance shutter 10 for 10 GHz in the X band. It is assumed that $A' = 1.4$ cm and $B' = 0.28$ cm. The conductance of such a shutter can be determined on the basis of the formulas for laminar flow used by A. Roth on page 70.

It is further efficient in the arrangement used in Example 1 to insert before the pump a throttle valve or a pressure controller for controlling $p_b$, so as to be able to adjust $p_b$ to any desired value. Furthermore, a further pump for gas discharge from the reaction chamber can be inserted, relieving the rotary vane pump at b. Finally, in view of the quadratic relationship in (3) it is more advantageous also for the arrangement used in Example 1 to insert a second pumping stage at a distance of approximately 2 m from the first pumping stage.

EXAMPLE 2.

A pressure lock for microwave coupling as shown in FIG. 1 for the E band (60 to 90 GHz) appears to be distinctly more favourable. It is perfectly suitable for outcoupling without apertures high-power microwaves, for example, 200 kW, from a 70 GHz gyrotron in a direction of microwave transmission from "b" to "a". Owing to the rather small required transverse dimensions of the wave guide no resonance shutters are required in such an arrangement. Up to the first pumping stage (exhaust tube 6) comprising a rotary vane pump having a throughput of $S_p^{(1)}=580\ m^3/h$, two pumping slots 2 being positioned in the two narrow sides at distances $L_1=20$ m from the "input" a of the rectangular wave guide spiral, the E band spiral wave guide remains without slots. From (3) it follows, with A=0.31 cm=2B, that $p_1=38$ Torr=50.5 hPa. Another rotary vane pump (exhaust tube 7) at a distance of 1.5 m from the pumping slots 2, which pump has a throughput of $S_p^{(2)}=76\ m^3/h$, then results in the fact that there will be a pressure of approximately 10 Torr=13.3 hPa at the output "b". This second pumping stage is required on account of the quadratic dependence in (3) and creates a distinctly smaller overall length L than when only a single pumping stage is used.

The power attenuation of the E band wave with $\nu_o=70$ GHz then amounts to 0.027 dB/m. 21.5 m=0.58 dB or approximately 13%.

Figure 3:
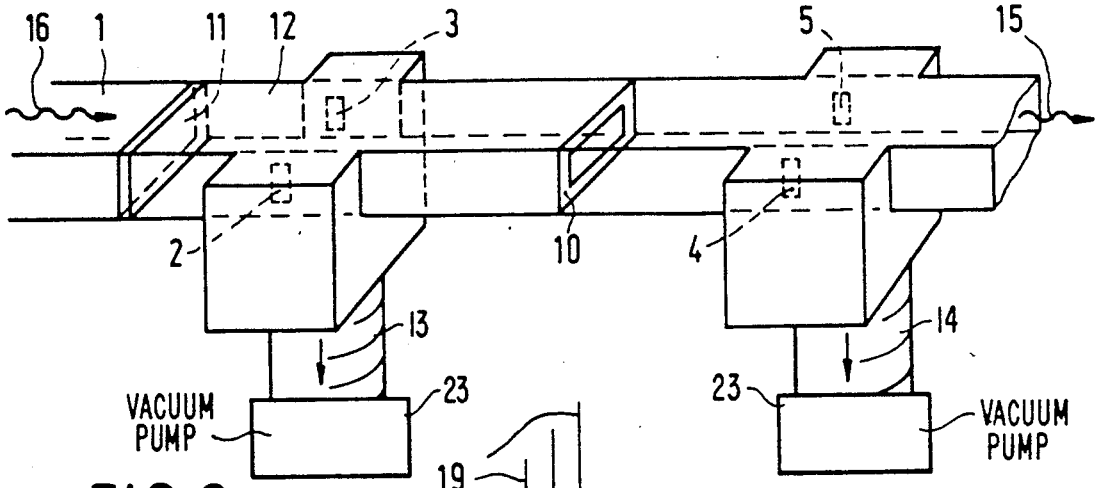

The arrangement represented in FIG. 3 relates to the use in combination with a microwave plasma reactor. In this arrangement the microwave transmission is effected through a wave guide 1, which is hermetically sealed to the low-pressure side 12 at a place with a microwave aperture 11 of dielectric material, for example, glass, quartz, PTFE. The low-pressure side is evacuated through two slots 2 and 3 in the narrow sides of the wave guide to a low final pressure of, for example, $1.33\times10^{-4}$ Torr$=10^{-2}$ hPa by a first rotary vane vacuum pump 23 attached to pump pipe 13, so that also with high microwave power densities no microwave gas discharge is ignited and the aperture always remains free. In the wave guide there is again a rise of pressure up to an operating point of, for example, 10 hPa in the reaction chamber formed as a microwave resonator. A second rotary vane vacuum pump 24 attached to pump pipe 14 is pumping out the reaction chamber through two opposite further slots 4 and 5 at the distance L between the pump pipe 13 and the coupling place, and is used both for relieving the pump 23 and for gas discharge, that is, for removing gaseous PCVD end products. For a better decoupling of the two pump regions one or various resonance shutters 10 can be inserted into the wave guides (for example, X band).

A variant of this embodiment is obtained in that the vacuum region in the wave guide between the aperture 11 and the pump pipes 13 and 14 is filled with a quenching gas having a high dielectric strength, that is to say, filled with a quenching gas, for example, $SF_6$, and a pressure of approximately 10 Torr=13.3 hPa is built up at the aperture and in the reaction chamber also through the pump pipes 13 and 14, while it is again ensured by a series of resonance shutters between the pump pipes 13 and 14 that no blending of the reactive gases with the gas having a higher dielectric strength takes place in the reaction chamber. By means of such a gas it is avoided that a plasma is formed in the wave guide despite the low gas pressure and, consequently, that virtually no microwave power reaches the reaction chamber.

In the case of a multi-component PCVD deposition of metallic films in which, for example, also tungsten is deposited from $WF_6+H_2$, there is a still more elegant solution: instead of $SF_6$, $WF_6$ is fed into the reaction chamber on its way through the microwave feeder, because $WF_6$ also has a high dielectric strength.

Only in the reaction chamber will hydrogen and argon and if necessary further gaseous components be added and blended, argon causing the breakdown voltage to be lowered and a microwave plasma to be formed with not too large microwave powers, in fact not in the wave guide but in the reaction chamber, that is, in the cavity resonator.

According to the type of waves the coupling of the microwaves in the reaction chamber is effected through a coupling aperture or by means of an aerial pin through a coupling aperture. The coupling of the microwave oscillator (for example, Klystron, backward-wave oscillator, gyrotron is designated 16.

In the case of this variant the pump 23 and pump pipe 13 are omitted and it is at this spot that, for example, $WF_6$ or $SF_6$ is fed. If $SF_6$ is fed, pump pipe 14 continues pumping, and there are further resonance shutters in the rectangular wave guide after the slots 4 and 5 in the direction of the arrow 15. If $WF_6$ is fed, which is used for tungsten deposition in the reaction chamber, also the pump 23, pump pipe 14 and the slots 4 and 5 are omitted and the gas discharging is effected at an exhaust port of the reaction chamber.

Another possibility is the use of one or various low-attenuation wave guide couplers having parallel-arranged rectangular wave guides, which are evacuated separately or gas-rinsed and in which the coupling holes form an additional flow resistance (shutters). However, such an arrangement is only operable when the differences in pressure are not too large.

Figure 4:
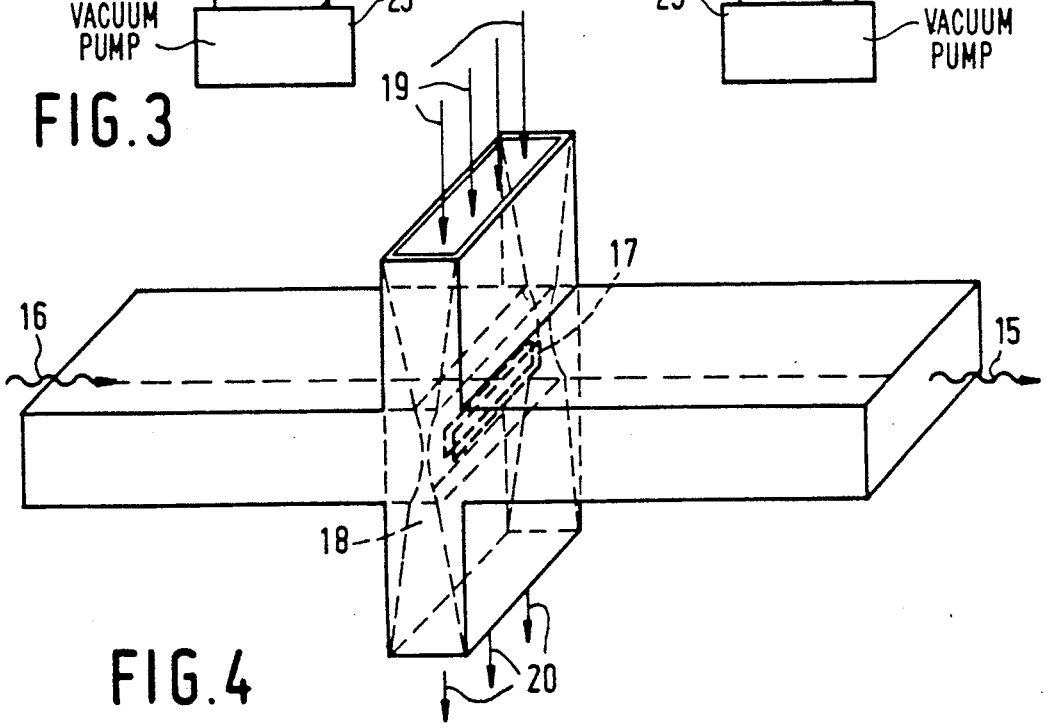

A third embodiment of the invention is the jetstream microwave aperture. FIG. 4 shows such an arrangement. In this arrangement the microwaves (arrow 16) are emitted through a double-walled resonance shutter 17 which is designed as a nozzle 18 for a flat high-velocity liquid jet (arrows 19 and 20), and again from an inside region of the wave guide having approximately atmospheric pressure into a low-pressure region.

The advantage of such a jetstream microwave aperture is among other things that no additional aperture cooling is required and no longer implies any restrictions on high microwave power levels. Furthermore, the evacuation effect of the jetstream can here be used additionally, as it is used in water jet pumps or in diffusion pumps. Microwave transmission will take place throughout a pump. In a further stage at the transition to high-vacuum, a steam jet nozzle can then be used instead of a liquid jet nozzle.

I claim:

1. Arrangement for microwave transmission in a wave guide path (1) between a relatively low pressure side and a relatively high pressure side comprising: cascaded relatively low and relatively high pressure wave guide regions and pump means operatively coupled to at least one of the wave guide regions (a, b) in a manner for establishing a differential pressure between said regions.

2. Arrangement as claimed in claim 1, characterized in that said pump means comprises vacuum pump means and is coupled to the relatively low pressure wave guide region at a spot proximate the low-pressure side.

3. Arrangement as claimed in claim 2, characterized in that the at least one wave guide region to which said pump means is coupled is adapted for microwave transmission in a predetermined microwave mode and said pump means is coupled to said at least one wave guide region at a slot in the wave guide which is located, shaped and oriented to minimize outcoupling from the predetermined microwave mode at a predetermined frequency.

4. Arrangement as claimed in claim 1, characterized in that the at least one wave guide region to which said pump means is coupled is adapted for microwave transmission in a predetermined microwave mode and said pump means is coupled to said at least one wave guide region at a slot in the wave guide which is located, shaped and oriented to minimize outcoupling from the predetermined microwave mode at a predetermined frequency.

5. An arrangement as claimed in claim 4, characterized in that the slot is provided in a vertical side wall of the wave guide and is shaped and oriented as a vertical rectangle.

6. Arrangement as claimed in claim 4, characterized in that the pump means is coupled to said relatively high pressure and said relatively low pressure wave guide regions at respective first and second spots which are spaced apart along said wave guide an integer multiple of one half wave length at the predetermined frequency.

7. Arrangement as claimed in claim 4, characterized in that the wave guide (1) has a rectangular cross-section and is multi-helical.

8. Arrangement as claimed in claim 1, characterized in that a resonance shutter is located in the wave guide (1) at a junction between the relatively low and the relatively high pressure wave guide regions.

9. Arrangement as claimed in claim 1, characterized in that a microwave aperture (11) is provided at the relatively low pressure side and further comprising means for coupling said microwave aperture to a microwave oscillator.

10. Arrangement as claimed in claim 9, further comprising means for coupling the relatively high pressure side to a reaction chamber and wherein said pump means is coupled to both said relatively high and said relatively low pressure regions.

11. Arrangement as claimed in claim 10, further comprising a resonance shutter (10) located at a junction between said relatively high and said relatively low pressure regions.

12. Arrangement as claimed in claim 1 characterized in that the wave guide (1) within at least one of the regions is filled with a gas having a high dielectric strength.

13. Arrangement as claimed in claim 1, characterized in that the wave guide (1) is filled with a gas selected from a rinsing gas, a quenching gas and a reactive gas.

14. Apparatus for microwave transmission comprising a waveguide path including first and second cascaded wave guide regions have different internal gas characteristics, selected from pressure and composition, and a double-walled resonance shutter at a junction between said regions, said resonance shutter being configured to act as a nozzle for a liquid jet across said shutter.

* * * * *